US005388382A

United States Patent [19]

Brooks

[11] Patent Number: 5,388,382

[45] Date of Patent: Feb. 14, 1995

[54] DISPLAY APPARATUS USING COLLAPSIBLE REINFORCEMENT BEAM

[75] Inventor: Harry M. Brooks, Upper Marlboro, Md.

[73] Assignee: Nomadic Structures, Inc., Springfield, Va.

[21] Appl. No.: 520,548

[22] Filed: May 8, 1990

[51] Int. Cl.[6] ..... E04C 2/30

[52] U.S. Cl. ..... 52/732.1; 52/720; 160/135; 211/195

[58] Field of Search ..... 160/135, 351, 352; 52/239, 241, 71, 720, 732.1; 211/195, 198, 199

[56] References Cited

U.S. PATENT DOCUMENTS

| | | | |
|---|---|---|---|
| 738,443 | 9/1903 | Henshaw . | |
| 1,457,255 | 5/1923 | Loveless . | |
| 1,863,594 | 6/1932 | Glende . | |
| 1,903,766 | 4/1933 | Johns . | |
| 1,970,256 | 8/1934 | Terrel . | |
| 2,075,401 | 3/1937 | Mosby . | |
| 2,118,135 | 5/1938 | Baldwin . | |
| 2,193,928 | 3/1940 | Johnson . | |
| 2,252,764 | 8/1941 | Farrell . | |
| 2,550,954 | 5/1951 | Benedict . | |
| 3,069,790 | 12/1962 | Oswald . | |
| 3,174,629 | 3/1965 | Gelberg et al. | 211/199 |
| 3,319,801 | 5/1967 | Nordstrom | 211/199 |
| 3,360,876 | 1/1968 | Nestegard . | |
| 3,559,814 | 2/1971 | Downing | 211/199 X |
| 3,562,973 | 2/1971 | Gangemi | 160/135 |
| 3,913,656 | 10/1975 | Guyer | 160/351 X |
| 4,356,648 | 11/1982 | Beaulieu | 40/155 |
| 4,357,773 | 11/1982 | Dennis . | |
| 4,459,773 | 7/1984 | Sandlin et al. . | |
| 4,627,210 | 12/1986 | Beaulieu | 52/646 |
| 4,658,560 | 4/1987 | Beaulieu | 52/646 |
| 4,727,994 | 3/1988 | Beaulieu | 211/198 |
| 4,865,111 | 9/1989 | Perutz | 160/135 |
| 4,945,706 | 8/1990 | Beaullieu | 160/368.1 X |
| 4,955,928 | 9/1990 | Tanner . | |
| 4,979,554 | 12/1990 | Nelson | 160/135 |

OTHER PUBLICATIONS

Mirage Marquee Header Assembly & Installation Instructions Brochure by Skyline Displays Inc., dated Nov. 11, 1989 (Exhibit A).

*Primary Examiner*—David M. Purol

*Attorney, Agent, or Firm*—Merchant, Gould, Smith, Edell, Welter & Schmidt

[57] ABSTRACT

Disclosed is a display panel apparatus (19) in which a flexible panel (15) has attached rigidifying beams (20). The rigidifying beams (20) have a plurality of hinged strips (21, 22, 23) which are attached to the panel (15) along its longitudinal edge(s). Magnetic strips are provided for maintaining the beams 20 in their operative state. The rigidifyed panel (19) may be used in connection with a collapsible support framework (11). A free-standing configuration of the display panel assembly (37) is also disclosed.

18 Claims, 4 Drawing Sheets

FIG. 4
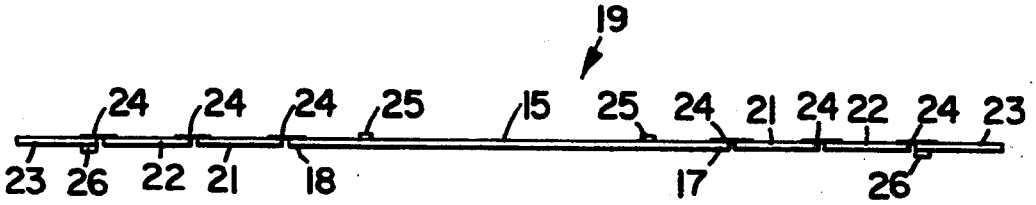
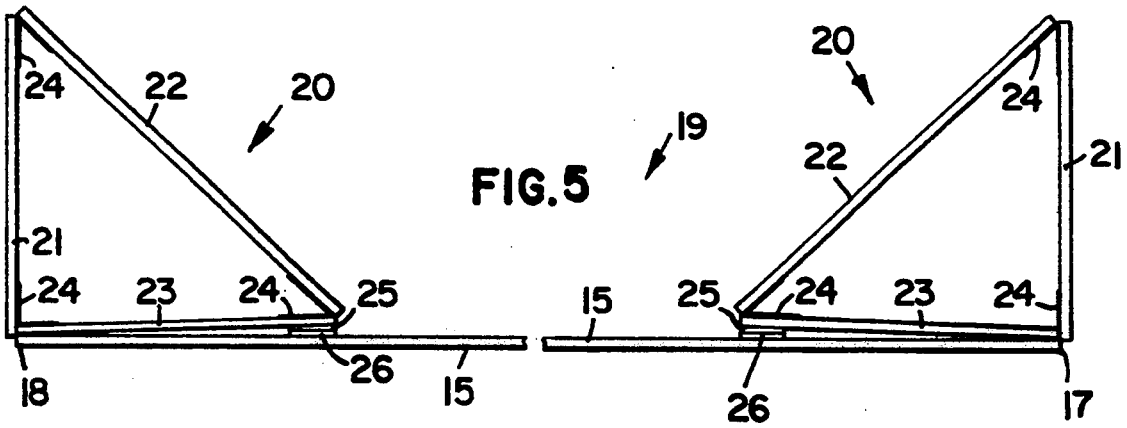
FIG. 5
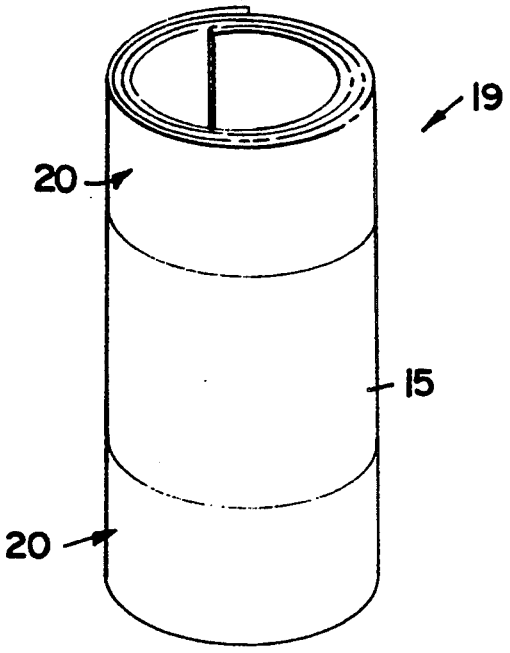
FIG. 6

DISPLAY APPARATUS USING COLLAPSIBLE REINFORCEMENT BEAM

FIELD OF THE INVENTION

The present invention relates generally to a display apparatus and more particularly to collapsible rigidifying beam members for use in reinforcing and mounting display banners.

BACKGROUND OF THE INVENTION

Large banners are often utilized in order to display information in a clear, aesthetically-pleasing manner, such as in connection with trade show displays and the like. It is desirable for the display banner to be easy to erect, to be durable and sturdy, to be reusable, and to have an attractive appearance.

Collapsible wall structures have been developed as part of such displays, such as the type described in U.S. Pat. No. 4,512,097. A common size for such wall structures is approximately eight feet tall by ten feet in width, which is the typical approximate size of an individual booth at many trade shows. It is common for such wall structures to form a convex or multi-sided shape, so that the wall structure can be free-standing and not require any additional support members. The free-standing configuration is also important so that the wall structure itself requires minimal space.

Mounted upon such wall structures, or upon any suitable support framework, are display banners or panels. These display banners are typically made of a flexible plastic material. The use of this type of material is advantageous, in that the banner can be rolled into a bundle for compact storage and ease of transportation, while at the same time being durable.

However, with conventional display assemblies, when a banner is hung from such a wall structure, the banner must typically follow the shape of and lie against the convex wall structure. The banner cannot be hung straight across so as to span the ends of the wall structure, because the banner would sag in the middle and result in an unattractive and difficult-to-read display. To provide lighting for this type of display, a plurality of lights are mounted upon booms which extend in front of the wall, the lighting being directed back toward the banner. With this type of assembly, backlighting of the display banner cannot be achieved.

Various attempts have been made to allow for the mounting of a rigid banner which spans across the convex wall structure, but none of these attempts have been entirely adequate. It is possible to simply use a banner constructed of rigid material; however, such a display banner or panel would be unduly cumbersome and would prevent the transportation of the banner from location to location. Another approach is to incorporate rigid support members upon the back side of the display banners. However, these rigid support members are typically non-collapsible and therefore difficult to store and transport, or the rigid support members block the light which is emitted from the backlighting source, thereby making backlighting either impossible or less effective. Also problematic is the use of rigid support members which are separate from the banner itself. This type of design requires a difficult, awkward and time-consuming assembly process in order to attach the support member to the display banner. This assembly process requires at least two people to attach the rigid support member and also causes complications when mounting the display banner to the support framework. Once the rigid support member finally is attached to the banner, it may detach itself from the back of the display banner, resulting in a display assembly which is structurally unsound.

The present invention addresses these and many other problems associated with currently available display apparatus.

SUMMARY OF THE INVENTION

The present invention comprises a display panel apparatus in which a flexible panel has rigidifying means which are movable between a flat configuration, and a rigidifying beam configuration. In the flat configuration, the apparatus is ready to be rolled and stored in a compact bundle. Preferably, the rigidifying means comprises one or two hinged beam members which are attached to the panel along its longitudinal edge(s). In the preferred embodiment disclosed herein, there are three parallel strips which form a triangular beam configuration when the panel apparatus is in its operable, rigid state. Retention means are also provided for maintaining this rigid state, preferably comprising magnetic strips. This type of display apparatus can be used in a free-standing manner or can be mounted upon a support framework. According to another aspect of the present invention, the inventive, rigidifyed panel is used in connection with a collapsible support framework. Attachment means are disclosed for mounting the panel upon the ends of a convex support framework. According to another aspect of the present invention, a method for erecting a display apparatus is disclosed, including the steps of unrolling the display panel assembly; moving the rigidifying members into their operable, polygonal configuration; moving the support framework structure into an erected configuration; and mounting the rigid display banner upon the support framework.

A primary advantage of the present invention is the ability to display a banner or header which has a rigid, structurally stable configuration. The rigid header can be mounted across a wall structure in such a manner as to allow backlighting behind the display banner, thereby producing a dramatic effect which draws attention to the display. Alternatively, the rigid display panel can be made free-standing as a single assembly or can be arranged in a side-by-side grouping.

Besides the aesthetics of the present invention, the display apparatus is also advantageous because of its ease of erection. The rigidifying beams are easily moved into their operable position, so as to make the panel ready to erect or ready to hang upon the support framework. The rigidifying beams are attached to the display panel itself, thereby greatly simplifying the assembly process and resulting in a savings of time and labor. The mounting of the banner to the support framework is also easily accomplished by means of simple brackets or other mounting means.

Yet another advantage of the present invention is its ease of storage. The present invention comprises only a single piece, rather than the display banner and rigidifying member being two or more separate pieces. The user need only return the banner and rigidifying beams to their flattened position, roll the display panel assembly into a cylindrical shape, and store it in a single suitable carrying case. In this manner, the display banner assembly is compact, lightweight, and easily portable.

For a better understanding of the invention, and of the advantages obtained by its use, reference should be made to the drawings and the accompanying descriptive matter, in which there is illustrated and described a preferred embodiment of the present invention.

BRIEF DESCRIPTION OF THE DRAWINGS

Referring particularly to the drawings, wherein like reference numerals indicate like parts throughout the several views:

FIG. 4 is an end view of the assembly illustrated in FIG. 3, in its flat configuration;

FIG. 5 is an enlarged, partially cut-away, end view of the assembly illustrated in FIGS. 3 and 4, in its operable configuration;

FIG. 6 is a perspective view of the display and beam assembly in its rolled configuration.

DETAILED DESCRIPTION OF THE PREFERRED EMBODIMENT

Figure 1:
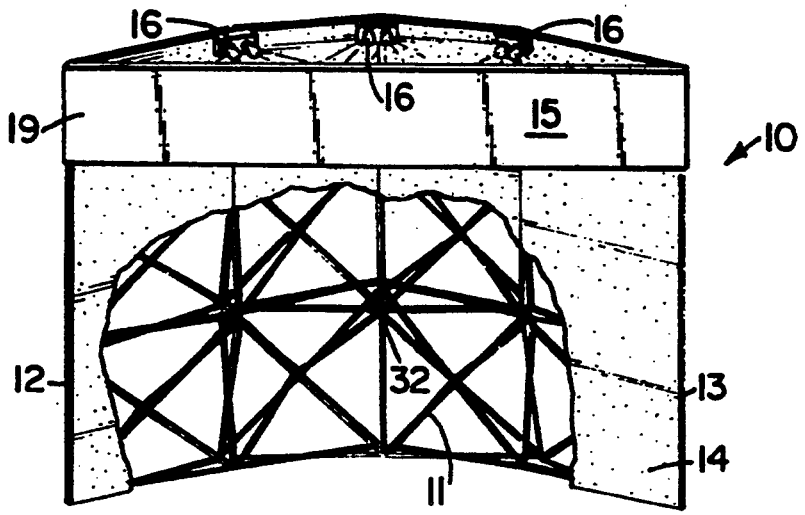
FIG. 1 a perspective, partially cut-away view of the display apparatus and support wall assembly of the present invention.
Figure 2:
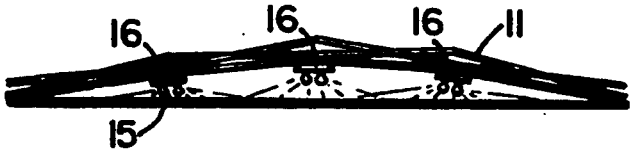
FIG. 2 a top view of the assembly illustrated in FIG. 1.

The display apparatus of the present invention is shown generally at 10 in FIG. 1. The display apparatus 10 includes a support wall structure 11 which has a generally convex or multi-sided shape so as to define an open face section between the two ends 12, 13 of the support wall 11. In the preferred embodiment the support wall 11 has a collapsible design which allows the support framework to be readily portable when in its collapsed configuration (not shown). The support wall 11 is free-standing and self-supporting. Preferably, the support framework 11 comprises an articulated wall structure having a plurality of rods or struts interconnected by a plurality of hubs 32, such as the type described in U.S. Pat. Nos. 4,512,097; Re. 31,641; 4,437,275; 4,290,244, all of which are owned by the assignee of the applicant herein.

The support framework 11 may be covered with an opaque covering 14 which is preferably hung in a series of strips from the top portion of the support framework 11. The covering 14 may terminate at the ends 12, 13 of the support framework 11; or, alternatively, the covering 14 may wrap around the support wall ends 12, 13 so as to produce a finished look. In the preferred embodiment, the covering 14 is made of a suitable foam-backed fabric which is laminated to a plastic material substrate such as a polyvinyl chloride or a polycarbonate material.

The display panel assembly 19 of the present invention extends across the open face of the support framework 11. Although the display panel portion 15 in FIG. 1 is illustrated as being blank, the display panel 15 would typically contain information or graphics, as appropriate for the particular application. The panel is preferably made of a plastic material having a thickness of 20–30 mil. The panel is approximately ten feet in length in the preferred embodiment, and has a width of approximately 15–18 inches, although it is to be understood that the present invention could be utilized with a wide variety of sizes and shapes of display panels 15. In addition, the panel 15 may include a "wraparound" portion on each end so as to extend around the end portions of the support framework 11.

Preferably, the back side of the fabric covering 14 has magnetic strips or other suitable attachment means which cooperate with corresponding magnetic strips (not shown) on the support framework 11. This attachment of the fabric 14 to the support framework 11 holds the covering 14 in place for an aesthetically pleasing and finished-looking display.

In the preferred embodiment, the header panel 15 is made of a polycarbonate material such as Lexan TM. This type of material is resilient, durable and lightweight, as well as being flexible so that it can be rolled up for storage and transportation purposes. The panel 15 may be completely opaque and multi-colored, or the panel 15 may have translucent portions, such as for the lettering or graphic portions of the banner 15. In the preferred embodiment, a plurality of light sources 16 are mounted upon the support framework 11 behind the panel 15 so as to shine light upon the back side of the panel 15 so as to produce a backlighting effect and project light through the translucent portions of the header.

The display panel 15 includes rigidifying means which allow the panel 15 to be erect and flat as illustrated in FIG. 1. The rigidifying means is attached to one or more of the edges 17, 18 of the header 15.

Figure 3:
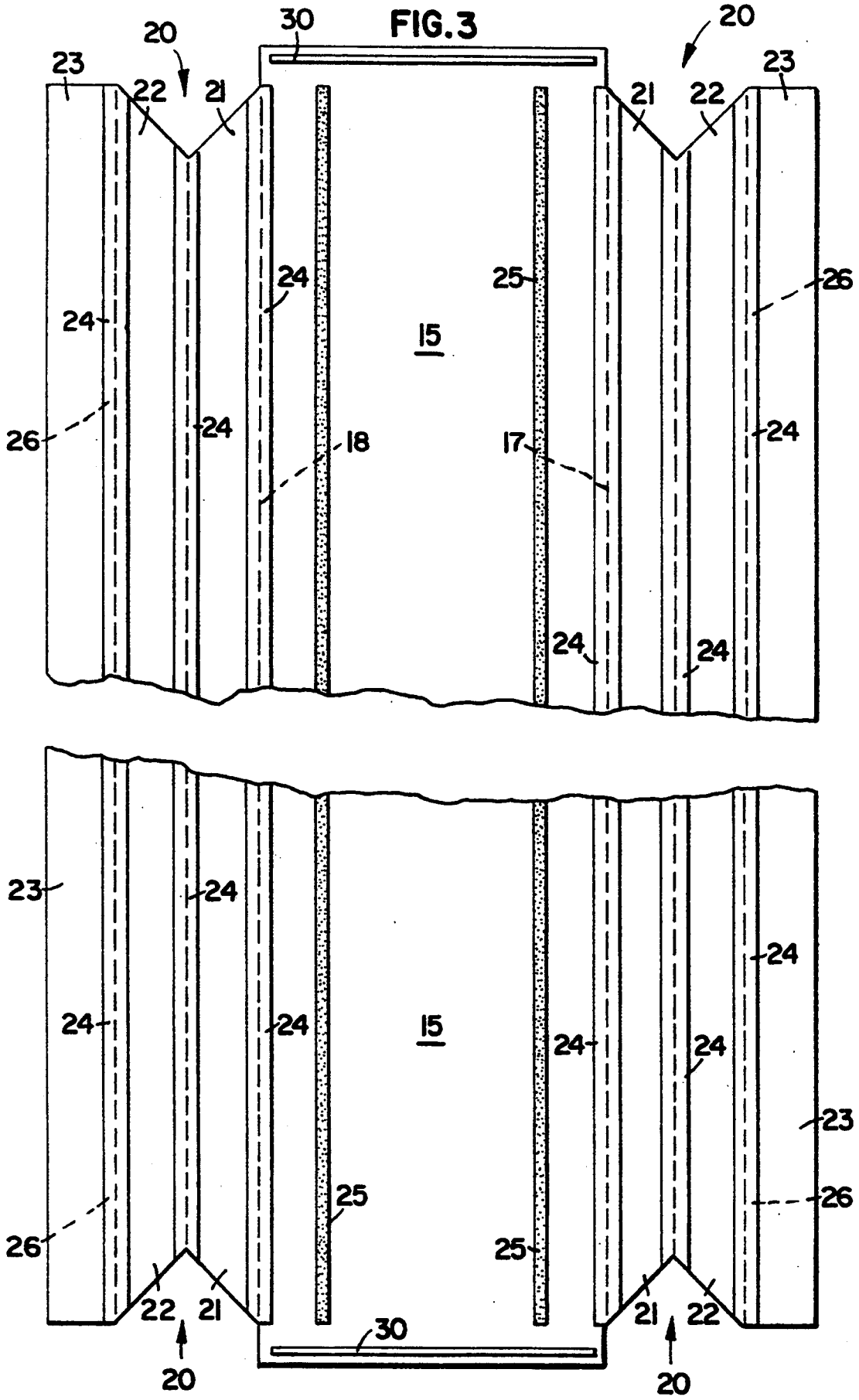
FIG. 3 is a plan view of the back side of the display panel and beam assembly.

In the preferred embodiment, the rigidifying means comprises one or more beam members 20. The beam members 20 include a plurality of parallel strips. In the preferred embodiment illustrated, there are three parallel strips 21, 22 and 23, strip 21 being attached to an edge 17 or 18 of the panel 15, strip 22 being the center strip, and strip 23 being the outside strip. The strips 21, 22, 23 are generally rectangular in shape of approximately the same size and shape. The strips are approximately two to three inches in width, in the embodiment illustrated in FIGS. 1–6. The embodiment illustrated in FIG. 3 shows a pair of beams 20, with each beam 20 being symmetrical and therefore having the same reference numerals. Each beam 20 is hingedly interconnected to the panel 15, and the strips 21, 22, 23 are hingedly interconnected to each other as well along their longitudinal edges. Preferably, the hinged connection means is a longitudinal strip of cloth tape, with the tape strips being indicated in the drawing as 24. However, any suitable hinge means could be employed, such as a metal or plastic hinge device, other types of tape, or any other device which is durable and able to withstand the heat emitted by the light sources 16. It is also to be understood that the tape 24 could be positioned on either or both sides of the beam strips 21, 22, 23.

The rigidifying means 20 are moveable between a flat, non-operative configuration, illustrated in FIG. 4, and a three-dimensional beam configuration, illustrated in FIG. 5. In the beam configuration, the strips 21, 22, 23 form a hollow, tubular member having a polygonal cross-section. The beam 20 which is formed provides reinforcement and rigidity to the display panel assembly 19. In this configuration, the display panel 15 becomes stiff and flat, thereby allowing the display panel 15 to achieve an aesthetically pleasing and stable appearance. It should be noted that the view illustrated in FIG. 5 is enlarged, with a portion of the panel section 15 being cut away, so as to clearly illustrate the details of construction. As is shown in FIG. 5, the polygonal member formed with the beam 20 is triangular in shape when in its operable position. However, it is to be understood that any polygonal shape, such as an octagon, square, rectangle, etc. could be utilized with the present invention by simply modifying the number and sizes of the beam strips utilized.

In the preferred embodiment, two beams 20 are positioned along the longitudinal edges of the panel 15. It is also within the scope of the invention to have a single beam 20, or to provide more than two reinforcement beams 20, depending upon the size, shape and support framework (if any) utilized with the display apparatus.

The strips 21, 22, 23 are made of a flexible material such as a polycarbonate material of approximately 30 mil. in thickness. This enables the entire display banner assembly 19 to be placed in its flat configuration (see FIG. 4) and then rolled into a cylindrical shape, such as that illustrated in FIG. 6. In this manner, the entire assembly can be placed in a single carrying case for simple and quick storage and transportation.

Retention means are also provided in the preferred embodiment so as to maintain the panel assembly 19 in its rigid, operable configuration. In the preferred embodiment, the retention means comprises a pair of parallel, magnetic strips 25 attached to the back side of the panel 15. The panel magnetic strips 25 are cooperable with corresponding magnetic strips 26 on the beam structure 20, as illustrated in FIG. 5. Alternative retention means could also be employed, such as Velcro TM hook and loop material, snaps, adhesive tape, etc. Further, the retention means 26 need not be in the form of parallel, continuous strips, but could rather be a plurality of discrete attachment members.

In the embodiment illustrated in FIG. 3, the beam members 20 are interconnected to the central display panel 15 by means of a tape strip 24. This provides the necessary hinged connection, as well as permitting the beams 20 to be removable from the panel 15 if, for example, the user desires to apply the beams 20 to a different header. However, the display assembly 19 could be constructed so that the beams 20 are permanently attached to the panel 15. With this design, the display panel 15 and beam assembly 20 would be of a single piece.

The present invention also includes means for mounting the header assembly 19 upon the support framework 11. In the preferred embodiment, the mounting means comprises a pair of brackets 30. The brackets 30 may be a pair of hooks, which extend over the top of the covering 14. Alternatively, the hooks 30 could cooperate with the support framework 11 by attaching to or over the framework's tubes or upper hubs 32. Other secondary attachment means may also be employed, such as Velcro TM hook and loop material, magnetic strips, and other devices well known to those skilled in the art. The brackets 30 are attached to the support framework 11 at or proximate to the ends 12, 13 of the support framework 11.

Because the beams 20 are of relatively small width in comparison to the width of the panel 15 and are preferably positioned along the edge of the panel 15, the beams 20 do not interfere with the backlighting of the panel 15 and therefore do not interfere with the aesthetic effect which is thereby created. The beams 20 therefore need not be translucent, and in fact could be made colored or constructed to be of a unique shape so as to enhance the aesthetic backlighting effect.

Figure 7:
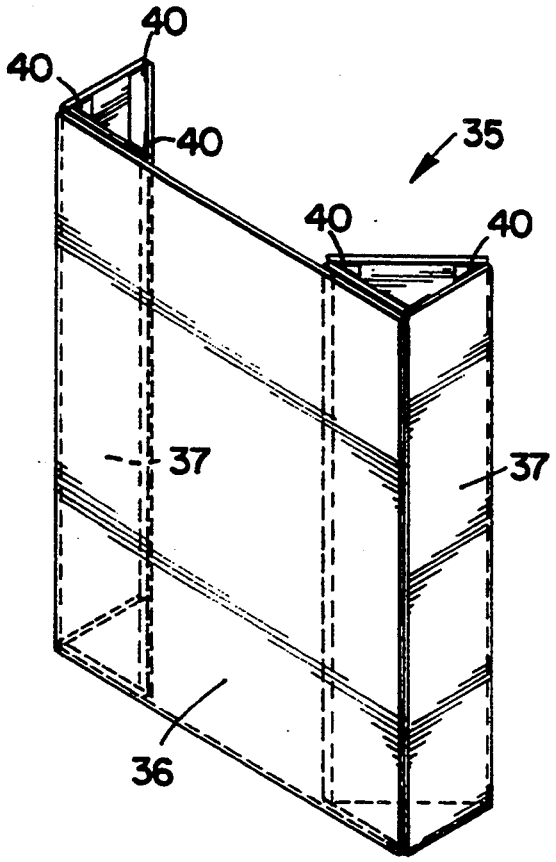
FIG. 7 is a perspective view of the second, free-standing embodiment of the present invention.

FIG. 7 illustrates an alternative embodiment 35 of the display panel assembly of the present invention. As illustrated, the display panel assembly 35 is free-standing and self-supporting; it does not require a separate support wall structure such as that discussed above. The display panel assembly 35 includes a display panel 36 and one or more beam assemblies 37. The display panel 36 is analogous to display panel 15 described above, and the beams 37 are analogous to the beam 20 described above. The beams 37 have hinged connections as described with the previous embodiment. The display panel assembly 35 can be of a wide variety of shapes and sizes, as determined by the structural stability requirements and the space requirements needed to display the information or graphics upon the panel 36. In addition, a plurality of free-standing display assemblies 35 can be erected in a side-by-side configuration, so that the adjacent display panel assemblies 35 are either completely separate, or are removably attachable by Velcro TM hook and loop material, or other attachment means known in the art.

The display panel 36 may also be covered with a covering fabric (not shown) if this type of aesthetic effect is desired. In addition, the beams 37 could be of a wide variety of sizes and shapes for structural, aesthetic, or ease-of-assembly purposes. For example, if a plurality of display panels 36 are being positioned side-by-side so as to form a continuous, curved display surface, then the size and angle of the beams 37 could be adjusted so that the adjacent beams 37 abut each other.

It is to be understood that numerous and various modifications can be readily devised in accordance with the principals of the present invention by those skilled in the art without departing from the spirit and scope of the invention. Therefore, it is not desired to restrict the invention to the particular construction illustrated and described, but to cover all modifications that may fall within the scope of the appended claims.

What is claimed is:

1. A panel apparatus, comprising:

a) a panel of flexible material, said panel being movable between a first, rolled configuration and a second, flat configuration; and b) rigidifying means of flexible material and attached to said panel, said rigidifying means being movable between a first, flat configuration and a second, polygonal configuration, said rigidifying means being parallel to a longitudinal dimension of said panel, wherein said rigidifying means comprises a plurality of strips which are hingedly interconnected to each other, said rigidifying means being hingedly attached to said panel.

2. The panel apparatus of claim 1, wherein said strips are made of a polycarbonate material.

3. The panel apparatus of claim 1, wherein said rigidifying means comprises three strips in a parallel relationship, said strips having a triangular cross-section when in said polygonal configuration.

4. The panel apparatus of claim 3, wherein said strips are hingedly interconnected by means of tape.

5. The panel apparatus of claim 1, further comprising retention means for releasably holding said rigidifying means in its polygonal configuration.

6. The panel apparatus of claim 5, wherein said retention means comprises a pair of magnetic members, one magnetic member being mounted upon said panel, one magnetic member being mounted upon one of said strips, and said magnetic members abutting each other when said rigidifying means is in its polygonal configuration.

7. The panel apparatus of claim 3, further comprising bracket means for mounting said panel apparatus upon a support framework.

8. The panel apparatus of claim 7, wherein said support framework is collapsible.

9. A panel apparatus, comprising:

a) a panel of flexible material, said panel having two parallel edges;

b) a pair of beam members, each being attached to one of said parallel edges, said beam members including three flexible strips, said strips being movable between a flat configuration and a triangular configuration;

c) beam attachment means for removably attaching a pair of innermost strips to said panel; and d) retention means for releasably holding said beam members in said triangular configuration.

10. The panel apparatus of claim 9, wherein said retention means comprises a magnetic strip on said beam member cooperable with a magnetic strip on said panel.

11. The panel apparatus of claim 10, wherein said strips are made of a polycarbonate material.

12. The panel apparatus of claim 10, wherein said strips are hingedly interconnect to each other by means of tape.

13. The panel apparatus of claim 9, wherein an innermost strip is removably attached to said panel with hook and loop fastener material.

14. A display apparatus, comprising:

a) a rectangular header panel of flexible, rollable material, said header panel including rigidifying means which are repeatedly movable between a first, flat configuration and a second, beam configuration, said rigidifying means being positioned proximate an edge of said panel, wherein said rigidifying means comprises a plurality of strips which are hingedly interconnected to each other, one of said strips being hingedly attached to said panel, said strips forming a hollow, polygonal member when in said beam configuration;

b) a collapsible support framework having a substantially convex configuration and a face portion between two ends, wherein said header panel spans said face portion;

c) attachment means for mounting said header panel proximate said two ends of said support framework; and d) lighting means for directing light toward a rear side of said header panel.

15. A display apparatus of claim 14, further comprising retention means for releasably holding said rigidifying means in its beam configuration.

16. A display apparatus of claim 15, wherein said rigidifying means comprises three rectangular strips in a parallel relationship, said strips forming a triangular cross-section when in said beam configuration.

17. A panel apparatus, comprising:

a) a panel of flexible material, said panel being movable between a first, rolled configuration and a second, flat configuration; and b) rigidifying means of flexible material and attached to said panel, said rigidifying means being movable between a first, flat configuration and a second, polygonal configuration, said rigidifying means being parallel to a longitudinal dimension of said panel, wherein said rigidifying means comprises a plurality of strips which are hingedly interconnected to each other, said rigidifying means being hingedly and removably attached to said panel.

18. The panel apparatus of claim 17, wherein an innermost strip is removably attached to said panel with hook and loop fastener material.

* * * * *

UNITED STATES PATENT AND TRADEMARK OFFICE
CERTIFICATE OF CORRECTION

PATENT NO. : 5,388,382

DATED : February 14, 1995

INVENTOR(S) : Harry M. Brooks

It is certified that error appears in the above-identified patent and that said Letters Patent is hereby corrected as shown below:

On column 6, line 31, please delete "principals" and substitute therefore --principles--

On column 7, line 24 (claim 12), please delete "interconnect" and substitute therefore --interconnected--

Signed and Sealed this

Twenty-fifth Day of July, 1995

Bruce Lehman

*Attest:*

BRUCE LEHMAN

*Attesting Officer*

*Commissioner of Patents and Trademarks*